US010645486B1

(12) United States Patent
Rodgers et al.

(10) Patent No.: US 10,645,486 B1
(45) Date of Patent: May 5, 2020

(54) LOUDSPEAKER SYSTEM WITH PASSIVE RADIATORS

(71) Applicant: Rogersound Labs, LLC, Calabasas, CA (US)

(72) Inventors: Joseph Rodgers, Calabasas, CA (US); Howard Rodgers, Calabasas, CA (US)

(73) Assignee: ROGERSOUND LABS, LLC, Calabasas, CA (US)

( * ) Notice: Subject to any disclaimer, the term of this patent is extended or adjusted under 35 U.S.C. 154(b) by 0 days.

(21) Appl. No.: 16/572,318

(22) Filed: Sep. 16, 2019

(51) Int. Cl.
*H04R 1/28* (2006.01)
*H04R 1/02* (2006.01)

(52) U.S. Cl.
CPC ..... *H04R 1/2834* (2013.01); *H04R 1/025* (2013.01)

(58) Field of Classification Search
CPC .... H04R 1/283; H04R 1/2834; H04R 1/2869; H04R 1/2873; H04R 1/2884; H04R 1/2888; H04R 1/28; H04R 1/2803; H04R 1/2807; H04R 1/2811; H04R 1/2815; H04R 1/2819; H04R 1/2823; H04R 1/2826
See application file for complete search history.

(56) References Cited

U.S. PATENT DOCUMENTS

| | | | | |
|---|---|---|---|---|
| 2,805,729 | A | * | 9/1957 | Read |
| 2,866,514 | A | * | 12/1958 | Weathers |
| 4,286,688 | A | * | 9/1981 | O'Malley |
| 4,350,847 | A | | 9/1982 | Polk |
| 5,012,889 | A | | 5/1991 | Rodgers |
| 5,111,905 | A | | 5/1992 | Rodgers |
| 5,313,525 | A | | 5/1994 | Klasco |
| 6,158,823 | A | | 12/2000 | Schuck |
| 6,566,960 | B1 | | 5/2003 | Carver |
| 6,644,761 | B2 | | 11/2003 | Schuck |
| 8,256,566 | B1 | | 9/2012 | Rodgers |
| 8,397,860 | B2 | | 3/2013 | Rodgers |
| 9,462,391 | B2 | | 10/2016 | Johnston et al. |

* cited by examiner

*Primary Examiner* — Kile O Blair
(74) *Attorney, Agent, or Firm* — Loza & Loza, LLP; Gordon R. Lindeen, III

(57) ABSTRACT

A loudspeaker system is described that includes passive radiators in opposite side panels adjacent to and on either side of a front panel speaker driver. A first front partition within the enclosure is attached to the enclosure at a first attachment point between the speaker driver and the first passive radiator and extends into the enclosure at an angle from the front panel. A second front partition within the enclosure is attached to the enclosure at a second attachment point between the speaker driver and the second passive radiator and also extends into the enclosure at an angle from the front panel.

20 Claims, 5 Drawing Sheets

LOUDSPEAKER SYSTEM WITH PASSIVE RADIATORS

FIELD

The present description relates to the field of loudspeaker systems and more particularly to a speaker enclosure for a loudspeaker system with internal partitions and passive radiators.

BACKGROUND

Dynamic loudspeaker systems typically use a main panel to carry a speaker driver or acoustic transducer and an enclosure behind the driver. The main panel may be on the front, a side, or the bottom. The driver has a diaphragm driven by a voice coil and magnet, sometimes called a motor, to move the ambient air outside the enclosure, creating sound waves. Air is moved both in front of and behind the diaphragm. The air in front of the diaphragm generates sound waves into a room or another listening environment. The air behind the diaphragm is in the enclosure.

Different enclosure designs handle the sound waves that come off the back of the diaphragm. While some systems do not use an enclosure, an enclosure can extend the bass response or improve the efficiency of the loudspeaker system. A sealed acoustic suspension enclosure uses the air in the enclosure to generate spring resistance against the diaphragm of the acoustic transducer. A bass reflex or tuned port enclosure allows the sound waves in the enclosure to escape through a carefully designed port with a delay. A passive radiator is used in a sealed enclosure as an alternative to a port. It is similar to an electrodynamic acoustic transducer but has no active voice coil. The sound waves in the enclosure drive the back side of the passive radiator diaphragm. The front side of the passive radiator creates sound waves into the listening environment.

The various known enclosure designs provide different advantages and disadvantages. The perceived quality of a particular design is difficult to predict. Music reproduction is complex and cannot be fully and accurately modeled. The sounds from different voices and musical instruments reinforce and interfere with one another in a complex way that changes as the sounds change through a musical passage. Each person's perception of the quality and accuracy of the same reproduced sounds can also differ. There are also variations in how sound is recorded, stored, derived from storage, and amplified into the voice coil. Different dynamic drivers also differ. As a result, different designs are preferred for reproducing different sounds by different people and many different types of enclosure designs continue to sell. Reproduction inaccuracies added by an enclosure or by diaphragm mounting may be perceived as adding warmth or impact or as compensating for another weakness in the complete system from source material to sound.

BRIEF DESCRIPTION OF THE DRAWING FIGURES

The invention may best be understood by referring to the following description and accompanying drawings that are used to illustrate embodiments of the invention. In the drawings.

DETAILED DESCRIPTION

Figure 1:
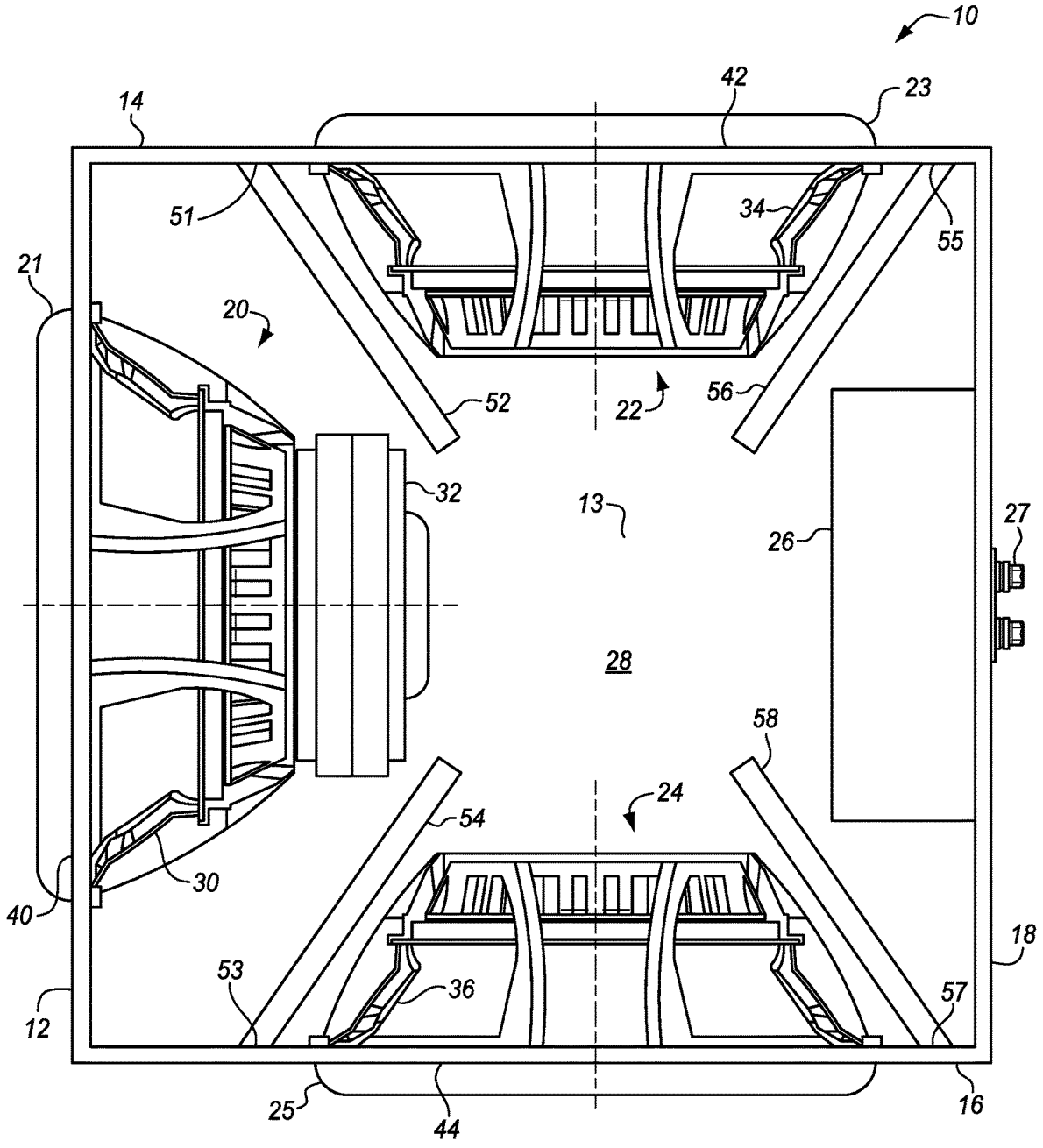
FIG. 1 is a top plan view of loudspeaker system with a top panel removed according to an embodiment of the invention.

FIG. 1 is a top plan view of a speaker system enclosure 10 for enhanced bass extension and reduced system resonance. It is illustrated with a top panel removed to show the placement of partitions inside the enclosure. The enclosure has a front panel 12 attached to two side panels 14, 16, that are in turn attached to a back panel 18. The panels are generally rectangular and perpendicular and may have different sizes and proportions, depending on the particular implementation. The top panel (not shown) is removed and the bottom panel 13 is below and between the panels. The six panels define a volume for the interior 28 for the enclosure 10.

A dynamic transducer or speaker driver 20 is mounted at an opening 40 in the front panel 12. While this is referred to as a "front panel" throughout, this panel may be on a top, bottom or side and is only to be regarded as being a "front panel" in that it is adjacent to and between the two side panels. The driver has a diaphragm or cone 30 driven by a motor 32 with a voice coil and a magnet in response to an electrical signal. Typically, an analog music or voice signal is provided to the voice coil to cause the diaphragm to oscillate in response to the analog signal, however, any of a variety of other types of sounds may be represented by signals that are provided to the diaphragm. The movement of the diaphragm, as driven by the voice coil against the magnet, causes sound waves to be generated in the ambient air in the listening environment outside the enclosure 10. The sound waves are perceived by a person outside the enclosure as sound. At the same time sound waves are also generated in the interior volume of the enclosure by the back side of the diaphragm.

The illustrated speaker driver 20 has a conventional construction with a rigid, typically steel or aluminum, frame or basket attached to the front panel 12. The diaphragm or cone 30 is attached at its periphery to the frame by a flexible surround 21, such as foam rubber, rubber, or cloth. The center of the diaphragm has a voice coil on one side and a dust cap on the other. The coil is placed near a magnet 32 that is also attached to the frame. While the description is presented in the context of such a conventional driver, any other suitable speaker driver may be used instead.

A passive radiator 22 is mounted to a side panel 14 at a second opening 42 and another passive radiator 24 is mounted to the other opposite side panel 16 at a third opening 44. The passive radiators have respective diaphragms 34, 36 but no motors. As shown, the side panels and respective radiators are adjacent the front panel with the driver. The sound waves generated in the interior volume by the speaker driver reach the diaphragms of the passive radiators causing those diaphragms to oscillate in response to the sound waves. This motion of the passive diaphragms causes further sound waves through the respective openings 42, 44 into the ambient air outside the enclosure.

The passive radiators may be similar to the active dynamic driver in size and construction. The radiators may be larger or smaller than the active dynamic driver and are typically the same size or larger. A rigid frame is attached to each side panel 14, 16. The diaphragm or cone 34, 36 is attached at its periphery to the frame by a flexible surround 23, 25, such as foam rubber, rubber or cloth. The center of the diaphragm is normally free to move as the sound waves drive it. There is no active voice coil and also no magnet for the voice coil. The resilience of the passive diaphragms is determined at least in part by the diaphragm material and the mounting structure by which it is attached to the frame. In some embodiments, weights are used in the center of the diaphragm or distributed across the diaphragm. The weights add inertia to the diaphragm to dampen and slow the motion of the diaphragm in response to the energy applied by the back side of the driver.

The back panel 18 is solid. It may provide a convenient location for wiring terminals 27, electronics 26, such as a crossover network and amplifier or other components. Alternatively some or all of these components may be mounted to the other side of the back panel, or any other panel outside of the interior 28 of the enclosure 10. Similarly, the top and bottom panels are also solid. In this context solid is used to mean acoustically opaque.

Loudspeaker enclosures also typically include a grille or cover to cover the cones and surrounds of the drivers. These are provided to improve the appearance of the enclosure and in many cases also protect the cones from damage. While there are no speaker grilles shown in FIGS. 1, 2, 3, and 4. Any suitable style grille, or cover may be added to suit particular implementations.

Throughout this description, reference is made to relative directions, such as "top", "bottom", "front", "back", "side" and similar terms. These terms refer to directions as the speaker enclosures are illustrated in the drawings; however, these terms do not dictate the orientations in which the speaker enclosures may be used. For example, it may be convenient to place a speaker enclosure on its side so that the "side" of the enclosure as described herein is actually the "bottom" of the enclosure as used with appropriate spacers from the floor or other support. This would allow acoustic coupling into the floor. In the same way, the front panel may be placed down for even greater acoustic coupling into the floor. The described enclosure may also be used on its "back" or upside down. Therefore, the use of such terms is not to be interpreted as limiting the invention in any regard.

The physical construction of the enclosure 10 may be adapted to suit different implementations. The walls and partitions of the enclosure 10 may be constructed from medium density fiberboard (MDF), high density fiberboard (HDF), particle board, plywood, plastics, metals, or any other suitable material having acoustical properties appropriate for use in the particular implementation of the loudspeaker enclosure. The individual panels are joined to one another by fasteners and/or glue, typically the joints are constructed so to be tight, and acoustically sealed without vibration. However, the invention is not so limited. The sealing of the seams prevents energy from the driver from escaping without being coupled into the radiators. Additional bracing may be used in corners and in other locations. While straight panels are shown, curved panels may be used for one or more of the surfaces and also, or alternatively, for the corners. The physical size of the enclosure may be determined in any desired way, depending on the particular implementation. In the illustrated example, Thiele-Small Speaker Parameters are used with a 12 inch class woofer to provide inside dimensions of 18 inches high by 161/2 inches wide and long. These dimensions may be modified to suit different sizes and types of drivers and to provide different acoustic qualities and physical form factors. The generally square shape may be rendered as a rectangle, an ellipse, or another shape with straight or curved sides to fulfill the same Thiele-Small or other enclosure parameters.

Inclined partitions 52, 54, 56, 58 are provided within the interior 28 of the enclosure 10. In the illustrated embodiment, the partitions are symmetrical, planar and inclined at an angle of about 45 degrees from the side walls. In the rectangular enclosure, the partitions are also angled at about 45 degrees from the front wall and the rear wall. Two partitions are attached to the side walls near the front panel and two are attached to the side walls near the rear panel to define different sections within the enclosure. The partitions define different sections of different sizes connected by narrow passages between them. The front partitions are inclined away from the front panel as a double wedge to narrow the opening from the back of the speaker driver diaphragm to the rest of the interior of the enclosure. The rear partitions are inclined away from the rear panel in the same way to create a narrowed opening into a larger rear section of the enclosure. The angle of the partitions may be modified to suit different driver and radiator sizes and different enclosure proportions. Inclination angles of 35 to 55 degrees will produce the same or a similar effect. "About 45 degrees" as used herein encompasses a range of 35 to 55 degrees and other inclination angles that provide the same function in the same way.

The partitions may be constructed of the same material as the enclosure and attached to the enclosure using the same technology that holds the enclosure together. For an MDF or plastic enclosure, MDF or plastic partitions may be glued to the top and bottom panels and to the attachment points of the side panels. For a metallic enclosure, MDF or plastic may still be used or a metal partition may be used attached by adhesive or by brazing, soldering or another technique.

As the pressurized air comes off the back of the driver 20 as sound waves, it goes through a sequence of compressions and expansions through the partitions. As the air passes between the front partitions to the middle of the enclosures it is compressed. The air expands into the center of the enclosure and then compresses through the partitions and expands further on the way to the passive radiators 22, 24. As the air propagates toward the rear panel, it is compressed between the rear partitions and expands into the section next to the rear panel. As it reflects off the rear panel it is compressed again through the space between the partitions and as it enters the center of the enclosure it expands again.

The compression and expansion mitigates the harmful effects of system resonance, which is harmful to the sound quality. In any speaker enclosure and especially with lower audio frequencies, the system resonance acts like a spring to cause the driver diaphragm to continue to vibrate after the applied electrical signal driving the voice coil has subsided. Movement of the diaphragm with no applied signal current results in a muddy sound. For subwoofers, the added sound allows the listener to hear the location of the subwoofer. If the subwoofer is not co-located with the satellites, then the localized subwoofer will not blend seamlessly with the other speakers. The listener perceives that the subwoofer is separate and apart from the satellites so that the perception of a detailed soundstage of musical sources is replaced by the perception of speakers in different locations in a room or other listening environment.

Mitigating system resonance can have a beneficial effect on all frequencies that a woofer, whether a subwoofer, mid-woofer, or other driver is asked to reproduce. In a normal enclosure, the system resonance is present on all frequencies that the woofer produces. Many loudspeaker enclosures are tuned to use one or more resonant acoustic frequencies to improve the sound produced by the loudspeaker. In some cases, the natural resonance is coupled to a port to create an impression of more power or more bass. However, the resonant frequencies within the enclosure cause many other problems including those described herein. Eliminating or greatly reducing the effects of system resonance results in cleaner, more accurate sound. In other words, it reduces an artifact of the reproduction system that is not part of the source material.

One purpose of many speaker enclosure designs is to cause the driver to produce louder sound especially in the lower audio frequencies. The compression and expansion of the partitions also applies an additional and different resistance to movement of the driver diaphragm. This provides a greater bass extension than for the same enclosure without the partitions. The loudspeaker system produces lower frequencies and produces those lower frequencies with a higher volume or amplitude. This improvement allows for a more engaging and realistic presentation of the source material. Alternatively, it allows for a smaller enclosure and less powerful amplifier to produce the same amount of bass extension.

In the illustrated example, each of the four partitions are the same size and extend from the side walls at the same angle. Each of the four partitions extend from a respective attachment point near an edge of the enclosure toward the center of the enclosure. The front partitions extend between the speaker driver and passive radiators. Specifically one of the front partitions 52 attaches to a side panel 14 of the enclosure 10 at an attachment point 51 between the front panel 12 and one of the passive radiators 22. The other of the front partitions 54 attaches to the opposite side panel 16 at an attachment point 53 between the front panel 12 and the other of the passive radiators 24. The other two partitions, the rear partitions 56, 58 have attachment points 55, 57 to the opposing side walls 14, 16 between the rear panel 18 and the passive radiators 22, 24. As a result, each passive radiator has a partition on each side.

The two partitions converge toward each other toward the center of the enclosure. This causes sound in the enclosure to compress to pass between the two partitions and then expand into the center of the enclosure. The sound is then compressed and expanded again toward each passive radiator. While the attachment points 51, 53, 55, 57 are shown on the side panels, one or both pairs may alternatively be in the corners or on the front or rear panel respectively. The attachment points may be adapted to suit different driver, radiator, and enclosure sizes and proportions.

The illustrated enclosure is rectangular with right angles at each corner. The angle at which each partition diverges is shown as 45 degrees from the side panel and also 45 degrees from the front or rear panel, respectively. These angles may be modified by at least 10 degrees to suit differences in the shape or proportions of the enclosure or for any other reason. These partitions 52, 54, 56, 58 extend from the bottom panel to the top panel and are acoustically sealed against those panels. The partitions are also acoustically sealed against the side panels at the respective attachment points 51, 53, 55, 57. In this way, the partitions improve the rigidity and strength of the enclosure and also brace the enclosure against resonance in the material of the enclosure. The rigid construction also helps to couple more of the acoustic energy into the passive radiators through which the energy is transmitted outside the enclosure. The partitions extend across the enclosure to block about one half of the width of the enclosure. The lengths of the partitions may be adapted to suit different driver, radiator, and enclosure sizes and proportions. The distance between the ends of the enclosures may vary from about two fifths to three fifths of the width of the enclosure or by about 50%±15% and other distances that provide the same compression/expansion function in the same way.

Figure 2:
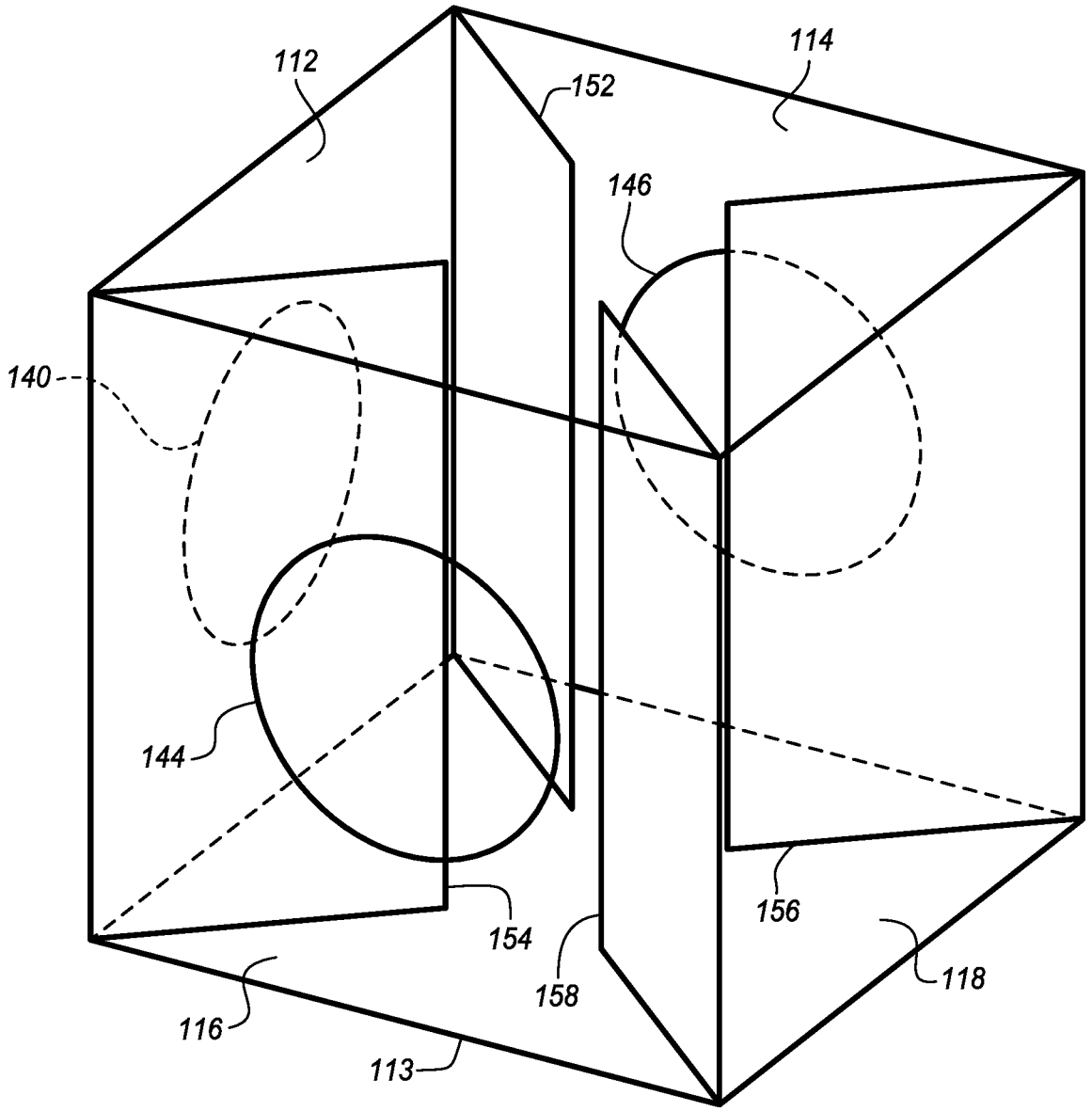
FIG. 2 is a partially transparent isometric view of a loudspeaker enclosure according to an embodiment of the invention.

FIG. 2 is a partially transparent isometric view of an alternative enclosure for a loudspeaker system without any drivers or radiators installed. In this embodiment, the front panel 112 is to the left in the drawing with two side panels 114, 116 attached at right angles at each end of the front panel. A rear panel 118 is attached to the ends of the side panels opposite the front panel. A bottom panel 113 attaches to each of the other panels and the top panel is not shown. The front panel has an opening 140 for a driver and the two side panels each have an opening 144, 146 for a passive radiator. As in the example of FIG. 1, the openings are each centered in the respective panel and are all the same size. The size of the radiators may be modified to suit different implementations and may be modified to accommodate different radiator designs, weights, and other radiator parameters.

A flat, planar partition 152, 154, 156, 158 extends from each corner of the enclosure 110 toward the center of the enclosure filling the entire space between the top panel and the bottom panel 113. These partitions are also inclined at about 45 degrees from both of the panels at each respective corner. As in the example of FIG. 1, the partitions close off about half of the distance between opposing panels. In other words, the distance between the ends of the partitions opposite the corners of the enclosure is about half of the total distance between the panels. This distance determines, at least in part, the amount of compression and expansion within the enclosure and may be adapted to suit different implementations.

Figure 3:
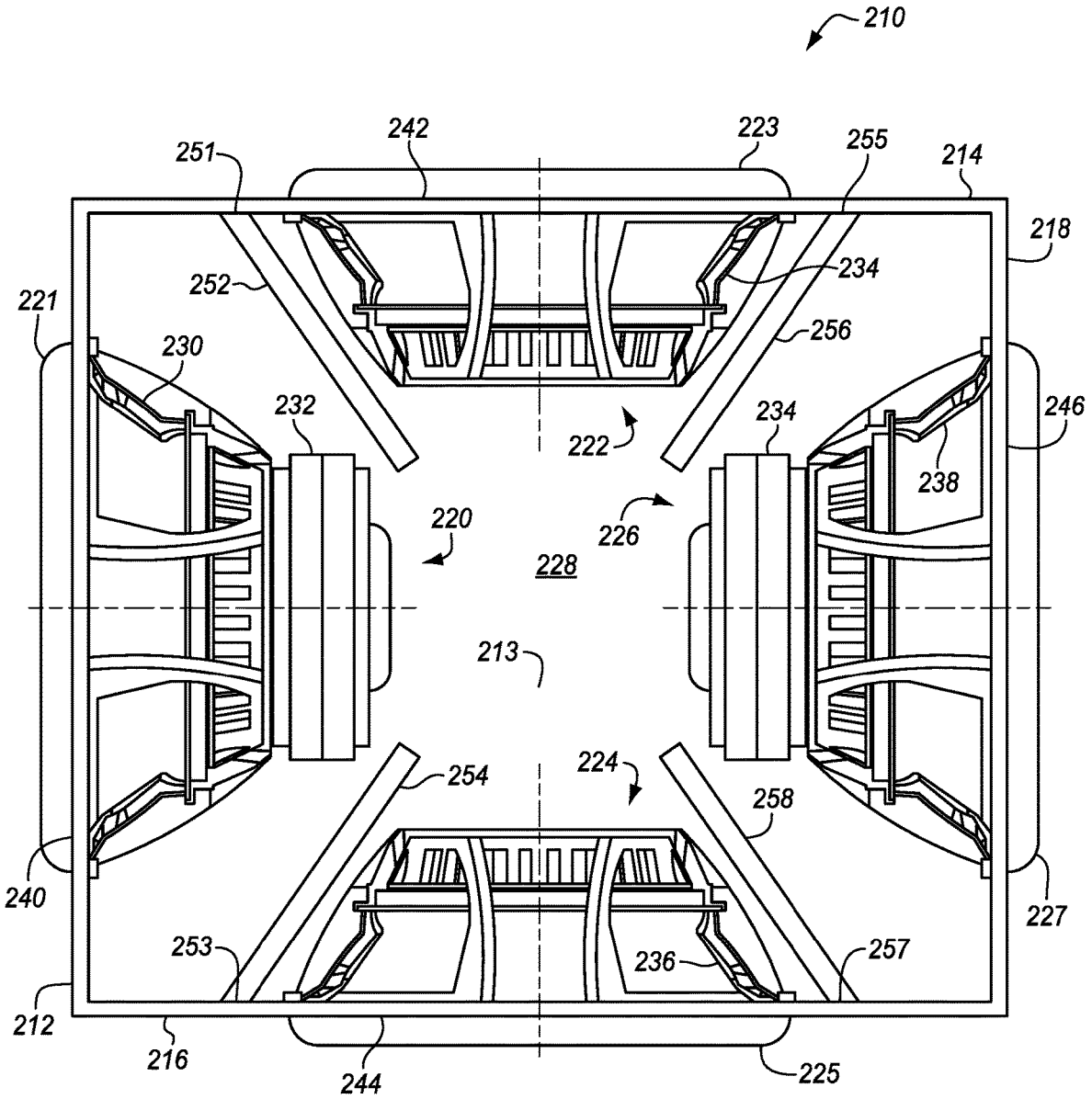
FIG. 3 is a top plan view of a twin driver loudspeaker system with a top panel removed according to an embodiment of the invention.

FIG. 3 is a top plan view of a loudspeaker system 210 with two speaker drivers and two passive radiators with the top panel removed. The enclosure 210 has a front panel 212 with a front driver 220 mounted to the front panel. A rear panel 218 is opposite the front panel with a rear driver 226 mounted to the rear panel. Side panels 214, 216 are adjacent to and extend between the front and rear panels and seal the enclosure together with a top panel (not shown) and a bottom panel 213. Passive radiators 222, 224 are mounted in each side panel respectively. Partitions 252, 254, 256, 258 extend from the side panels 214, 216, each from a respective side panel attachment point 251, 253, 255, 257 toward the center 228 of the enclosure between the drivers and the passive radiators. These partitions close off about half of the distance between the side panels to cause compression and expansion of sound waves between the front and rear panels and the side radiators.

The enclosure also includes an opening 240, 242, 244, 246 in the front, side and rear panels to carry the drivers and radiators. Each driver and radiator may optionally be covered by a respective grille (not shown). As in the other examples this enclosure may be made of 0.5 to 1 inch thick MDF or any other suitable material. The panels carrying the drivers may be made thicker than those carrying the radiators and thicker than the top and bottom panels. The partitions may be made of the same or a similar material.

The two drivers 220, 226 have respective motors 232, 234 that are wired in-phase so that the respective diaphragms 230, 238 of the drivers are both moving inward or outward in their respective suspensions 221, 227 at the same time. This increases the amplitude of the sound waves within the enclosure which in turn increases the force of the sound waves on the diaphragms 234, 236 of the passive radiators 224, 224 which move with respect to the enclosure in their respective suspensions 223, 225. With two drivers, the system will pump more sound into the ambient air outside the enclosure through the drivers but also more sound into the ambient air through the passive radiators. Because the two drivers are facing in opposite directions, the motion of one driver and the vibration from that motion that is coupled into the enclosure is cancelled by the equal and opposite motion of the opposite driver. Similarly, any vibration caused by one radiator is cancelled by the other radiator. The force of the sound waves inside the cabinet is increased, if not doubled, with less enclosure vibration.

The crossover and amplifier components 18 of FIG. 1 are not shown in FIG. 3. These components may be mounted on the top or bottom panel inside or outside of the enclosure or they may be mounted beside a driver or radiator depending on the size of the components and the available space.

In the example of FIG. 1, the front partitions are farther from the front panel than the rear partitions are from the rear panel. This provides more room for the voice coil and magnet of the speaker driver at the front panel. With a smaller speaker driver or more compact motor for the speaker driver, the front partitions may be closer to the front panel. Similarly in the example of FIG. 3, the enclosure is a little longer from the front panel to the rear panel to accommodate the additional speaker driver.

Figure 4:
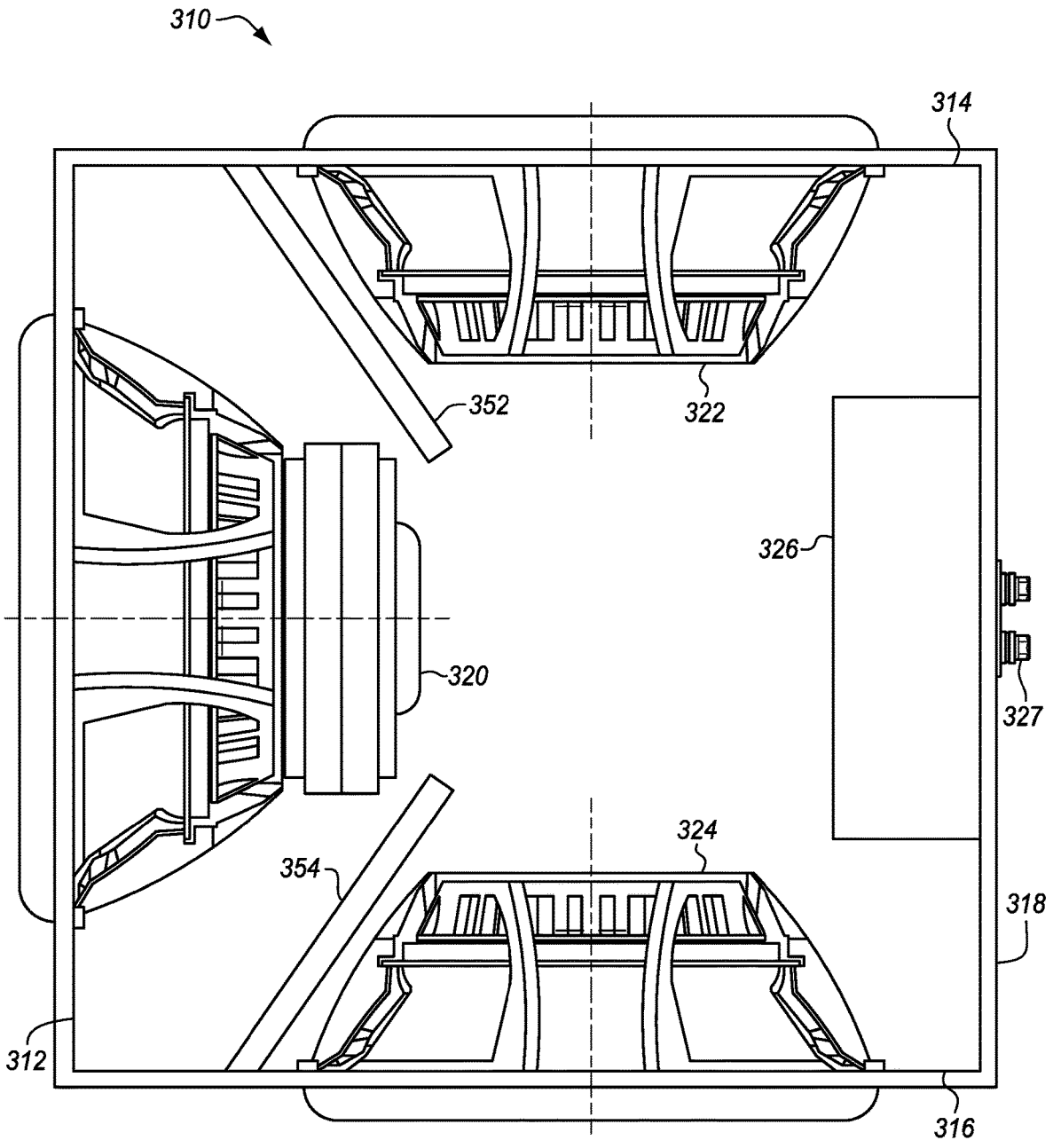
FIG. 4 is a top plan view of an alternative loudspeaker with a top panel removed according to an embodiment of the invention.

FIG. 4 is a top plan view of a loudspeaker system 210 with one speaker driver and two passive radiators with the top panel removed. In this enclosure 310 there is only one pair of partitions 352, 354 on either side of the front speaker driver 320. The enclosure 310 has a front panel 312 with the front driver 320 mounted to the front panel. A rear panel 318 is opposite the front panel and side panels 314, 316 are adjacent to and extend between the front and rear panels and seal the enclosure together with a top panel (not shown) and a bottom panel 313. Passive radiators 322, 324 are mounted in each side panel respectively. Electronics 326, such as an amplifier or crossover network are optionally mounted inside the enclosure with connection terminals 327 outside the enclosure.

The two front partitions 352, 354 extend from the side panels 314, 316 toward the center of the enclosure between the drivers and the passive radiators. These partitions close off about half of the distance between the side panels as in the previous examples to cause compression and expansion of sound waves between the front and rear panels and the side radiators. Since there is no pair of rear partitions, the front panels may have a smaller gap to cause more compression than in the above examples.

Figure 5:
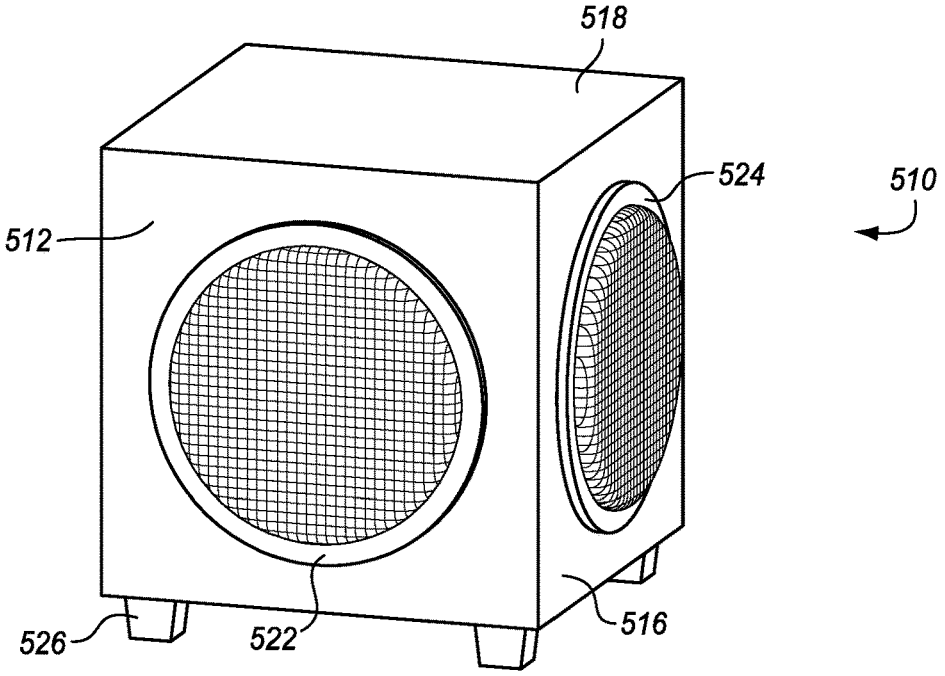
FIG. 5 is an isometric view of the loudspeaker system of FIG. 1 according to an embodiment of the invention.

FIG. 5 is an isometric view of the enclosure of FIG. 1, however, the enclosures of FIGS. 2, 3, and 4 may look the same or similar. The external enclosure 510 has a front panel 512, a side panel 516 and a top panel 518. The bottom, rear, and opposite side panels are not visible in this view. A speaker driver and grille 522 are mounted in the front panel and a passive radiator and grill 524 are mounted in the side panel. While only one passive radiator is required, in many implementations, there is another passive radiator (not shown) in the opposite side and there may be an additional speaker driver (not shown) on the rear panel. The enclosure has feet 526 to control the acoustic connection of the enclosure with the floor. The illustrated form factor is particularly well-suited for use as a subwoofer, but may serve as a lower frequency component of a full-range loudspeaker system.

Figure 6:
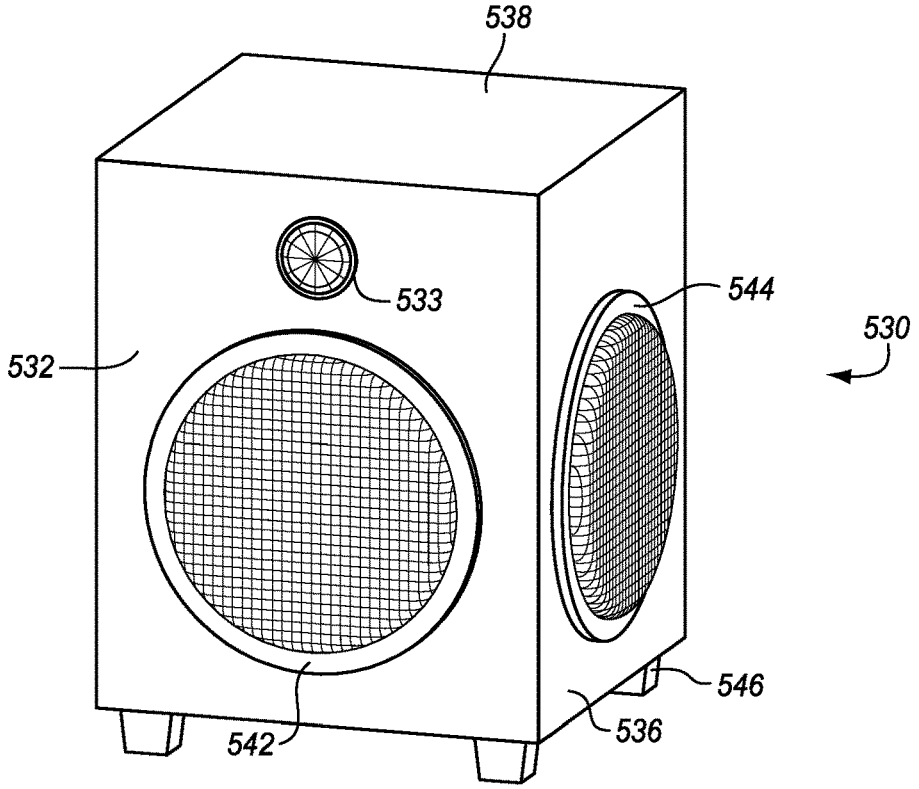
FIG. 6 is an isometric view of an alternative loudspeaker system according to an embodiment.

FIG. 6 is an isometric view of a full-range loudspeaker system using the principles described herein. The external enclosure 530 has a front panel 532, a side panel 536 and a top panel 538. The bottom, rear, and opposite side panels are not visible in this view. A speaker driver and grille 542 are mounted in the front panel and a passive radiator and grill 534 are mounted in the side panel. An additional second higher frequency range speaker driver 533 is also mounted to the front panel. When the first speaker driver is a woofer of, for example 3 to 18 inches class, the second speaker driver may be a tweeter to complement the woofer to provide a full range loudspeaker system. Feet 546 are mounted to the base or bottom panel of the enclosure to support the enclosure on a floor. Wall, ceiling, or stand mounts may be provided in addition or as alternatives, depending on the intended use.

The enclosure of FIG. 6 is taller than the enclosure of FIG. 5 to provide room for the tweeter. The front panel may be adapted to provide an ideal mounting position for the tweeter. The enclosure behind the tweeter may also provide a section of enclosure for the tweeter or the tweeter may be flat-mounted. The tweeter may alternatively be mounted to the top panel or in any of a variety of other ways for aesthetic and acoustic reasons. While only one tweeter is shown, there may be multiple drivers to provide a phased array, or to send sound waves in different directions. Additional drivers (not shown) may be mounted to the front panel to suit particular use scenarios. Additional passive radiators and woofer drivers (not shown) may also be mounted to the panels of the enclosure as shown in FIGS. 2, 3, and 4.

There are many formulas that are used to determine an appropriate enclosure size for a particular speaker driver or combination of drivers. Generally larger enclosures provide better sound but smaller enclosures are preferred by customers. The illustrated enclosures are smaller than many but provide better sound than comparably sized enclosures without the illustrated partitions. The described enclosures are roughly square as seen from the top. The panels are roughly one third larger in height and width than the frames of the drivers and radiators. While square enclosures are typically avoided because of system resonance, the interior partitions largely eliminate this resonance so that a more compact enclosure is possible. The proportions illustrated in these examples may be modified to suit different implementations. The enclosure may have a greater length than width as shown or vice versa. Any one or more of the sides may be curved as well. The specific dimensions of the enclosure may be tuned with the partitions to reduce system resonance so that the front or sides may be made smaller or larger to reduce resonance for a particular driver and radiator combination. The dimensions of roughly one third larger are selected to minimize system resonance.

The size of the enclosure may be adapted for a wide range of different speaker driver sizes from 3" drivers to 18" drivers and beyond. While the active drivers are shown as having the same diameter as the passive radiators, the invention is not so limited. Larger or smaller radiators may be used to suit different size enclosures and different active speaker drivers.

A lesser or more equipped enclosure, speaker driver, and passive radiator than the examples described above may be desirable for certain implementations. Therefore, the configuration of the system will vary from implementation to implementation depending upon numerous factors, such as price constraints, performance requirements, technological improvements, and/or other circumstances.

The present description presents the examples using particular terms, such as panel, partition, speaker driver, passive radiator, diaphragm, sound wave, components, etc. These terms are used to provide consistent, clear examples, however, the present invention is not limited to any particular terminology. Similar ideas, principles, methods, apparatus, and systems can be developed using different terminology in whole, or in part. In addition, the present invention can be applied to ideas, principles, methods, apparatus, and systems that are developed around different usage models and hardware configurations.

In the present description, for the purposes of explanation, numerous specific details are set forth in order to provide a thorough understanding of the present invention. However, the present invention can be practiced without some of these specific details. In other instances, well-known structures and devices are shown in block diagram form. The specific detail can be supplied by one of average skill in the art as appropriate for any particular implementation.

Although this disclosure describes illustrative embodiments of the invention in detail, it is to be understood that the invention is not limited to the precise embodiments described. The specification and drawings are, accordingly, to be regarded in an illustrative rather than a restrictive sense. Various adaptations, modifications and alterations may be practiced within the scope of the invention defined by the appended claims.

What is claimed is:

1. A loudspeaker system comprising:

a front panel of an enclosure having an opening;

a speaker driver attached to the front panel and configured to project sound through the front panel opening;

a first side panel of the enclosure adjacent to the front panel and having an opening;

a first passive radiator attached across the first side panel opening;

a second side panel of the enclosure adjacent to the front panel, opposite the first side panel and having an opening;

a second passive radiator attached across the second side panel opening;

a rear panel of the enclosure opposite the front panel and adjacent to the first side panel and the second side panel;

a top panel of the enclosure attached to each of the front, first side, second side, and rear panels;

a bottom panel of the enclosure attached to each of the front, first side, second side, and rear panels, such that the panels from an enclosure;

a first front partition within the enclosure attached to the enclosure at a first attachment point between the speaker driver and the first passive radiator and extending into the enclosure from the first attachment point at an angle from the front panel;

a second front partition within the enclosure attached to the enclosure at a second attachment point between the speaker driver and the second passive radiator and extending into the enclosure from the second attachment point at an angle from the front panel, the front partitions extending partially across the enclosure between the first and second side panels;

a first rear partition within the enclosure attached to the enclosure at a third attachment point between the rear panel and the first passive radiator and extending into the enclosure from the third attachment point at an angle from the rear panel; and a second rear partition within the enclosure attached to the enclosure at a fourth attachment point between the rear panel and the second passive radiator and extending into the enclosure from the fourth attachment point at an angle from the rear panel, the rear partitions extending partially across the enclosure between the first and second side panels.

2. The system of claim 1, wherein the first attachment point is on the first side panel and the second attachment point is on the second side panel.

3. The system of claim 1, wherein the angle is equal for the first and the second front partitions.

4. The system of claim 1, wherein the first and second front partitions are configured to reduce an interior space behind the speaker driver and between the partitions with increasing distance from the speaker driver.

5. The system of claim 1, wherein the first and second front partitions are configured to compress sound waves from the speaker driver and to expand the sound waves toward each respective passive radiator.

6. The system of claim 1, wherein the attachment points are each at a respective corner between a respective side panel and a front or rear panel and wherein the front and rear partitions extend from each respective corner toward the center of the enclosure and toward each other partition.

7. The system of claim 1, wherein the front partitions extend into the center of the enclosure so that the distance between the ends of the front partitions is about one half the distance between the two respective side panels.

8. The system of claim 1, wherein the front partitions are acoustically sealed against the top panel and the bottom panel.

9. The system of claim 8, wherein the second speaker driver is wired to operate in phase with the first speaker driver.

10. The system of claim 1, further comprising a second speaker driver attached to the rear panel and configured to project sound through an opening in the rear panel.

11. The system of claim 10, wherein the first and second rear partitions extend from between the second speaker driver and a respective one of the passive radiators toward the center of the enclosure.

12. The system of claim 1, further comprising a second speaker driver attached to the front panel configured to project sound from the enclosure, the second speaker driver configured to project sound of higher audio frequencies than the first speaker driver.

13. The system of claim 1, wherein the first side panel and the second side panel have the same surface area and are parallel.

14. The system of claim 1, wherein the front panel and the rear panel have the same surface area and are parallel.

15. A loudspeaker system comprising:

a rectangular enclosure having front, rear, side, top, and bottom panels;

a speaker driver attached to the front panel to drive sound;

first and second passive radiators on side panels adjacent to the front panel;

a first partition within the enclosure extending from a side panel between the speaker driver and the first passive radiator toward the center of the enclosure;

a second partition within the enclosure extending from a second opposite side panel between the speaker driver and the second passive radiator toward the center of the enclosure, the first and second partitions being angled from the front panel at an angle of about 45 degrees and extending into the center of the enclosure so that the distance between the ends of the first and second partitions is about one half the distance between the two respective side panels; and third and fourth partitions extending from respective opposite side panels and angled at about 45 degrees from the rear panel such that sound waves from the rear of the speaker driver are compressed by the first and second partitions, expanded into the center of the enclosure and compressed again by the third and fourth partitions upon approaching the rear panel.

16. The system of claim 15, wherein the partitions are each acoustically sealed against the top and bottom panels.

17. A loudspeaker system comprising:

a front panel and a rear panel;

first and second parallel planar side panels between and attaching the front and rear panels;

a speaker driver mounted to the front panel;

a first passive radiator mounted to the first side panel;

a second passive radiator mounted to the second side panel;

a first partition mounted to the enclosure between the speaker driver and the first passive radiator and extending toward the center of the enclosure behind the speaker driver;

a second partition mounted to the enclosure between the speaker driver and the second passive radiator and extending toward the center of the enclosure and the first partition behind the speaker driver, wherein the distance between the ends of the first and the second partition at the center of the enclosure behind the speaker driver is about one half the distance between the two respective side panels; and a third partition mounted to the enclosure between the rear panel and the first passive radiator and extending toward the center of the enclosure behind the speaker driver; and a fourth partition mounted to the enclosure between the rear panel and the second passive radiator and extending toward the center of the enclosure and the first partition behind the speaker driver.

18. The system of claim 17, wherein the first and second partitions are planar and extend at the same angle from the front panel for the same distance.

19. The system of claim 18, wherein the third and fourth partitions are planar, are mounted to a respective side panel, and extend at the same angle from the respective side panel for the same distance.

20. The system of claim 17, further comprising electronics mounted to the rear panel inside the enclosure with connection terminals mounted to the rear panel outside the enclosure.

* * * * *